United States Patent [19]

Steeb et al.

[11] 4,164,085

[45] Aug. 14, 1979

[54] ALBUM HAVING PICTURE RECEIVING FRAME ASSEMBLY IN COVER

[75] Inventors: William R. Steeb; Robert W. LeVeau, both of Overland Park, Kans.; Michael J. Falck, Peculiar, Mo.

[73] Assignee: Hallmark Cards, Incorporated, Kansas City, Mo.

[21] Appl. No.: 833,239

[22] Filed: Sep. 14, 1977

[51] Int. Cl.[2] ..... G09F 1/12

[52] U.S. Cl. ..... 40/152; 281/31

[58] Field of Search ..... 281/31; 40/10, 10 D, 40/10 R, 152

[56] References Cited

U.S. PATENT DOCUMENTS

| | | | |
|---|---|---|---|
| 478,390 | 7/1892 | Bergner | 281/31 |
| 2,801,115 | 7/1957 | Federbush | 281/31 |
| 2,850,294 | 9/1958 | Ortis et al. | 281/31 |
| 4,001,960 | 1/1977 | Holson | 281/31 |

*Primary Examiner*—Louis G. Mancene
*Assistant Examiner*—Wenceslao J. Contreras
*Attorney, Agent, or Firm*—Schmidt, Johnson, Hovey & Williams

[57] ABSTRACT

A keepsake album has a frame assembly imbedded in its padded front cover for displaying a personalizing photograph in recessed relation to the outer-surface of the cover. A photograph-receiving tray which forms a part of the frame assembly is disposed within a complementally configured blind opening in the cover and is solidly undersupported by the exposed rigid backing member of the cover along the bottom of the blind opening. The tray is adapted to releasably retain a decorative frame in abutment with the outer surface of the cover for holding the desired photograph in a displayed position on the cover.

5 Claims, 16 Drawing Figures

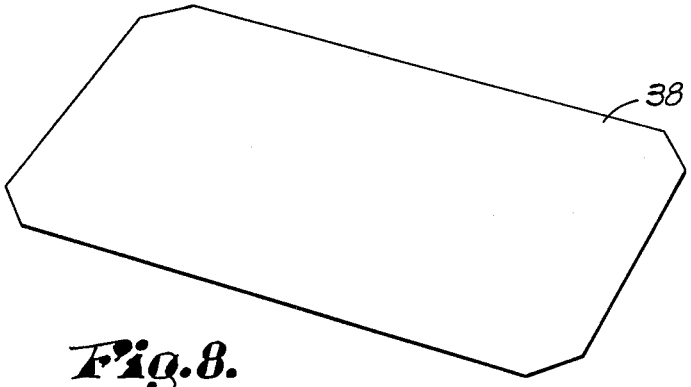
Fig. 8.
Fig. 9.
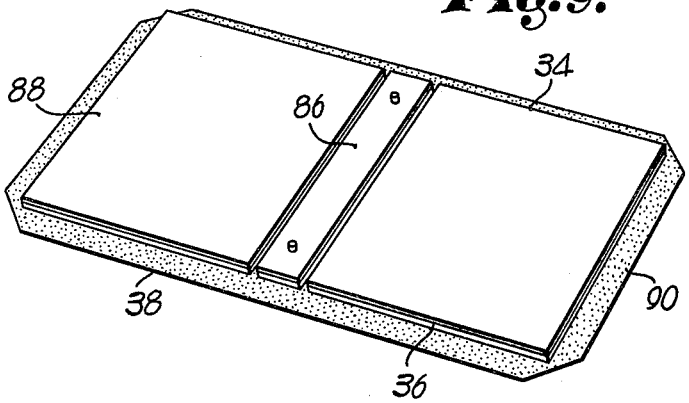
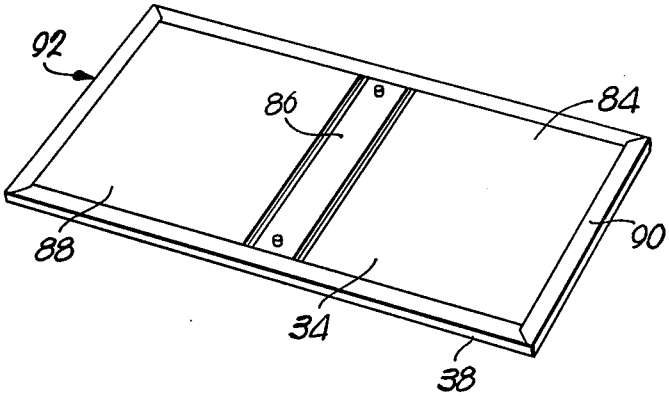
Fig. 10.
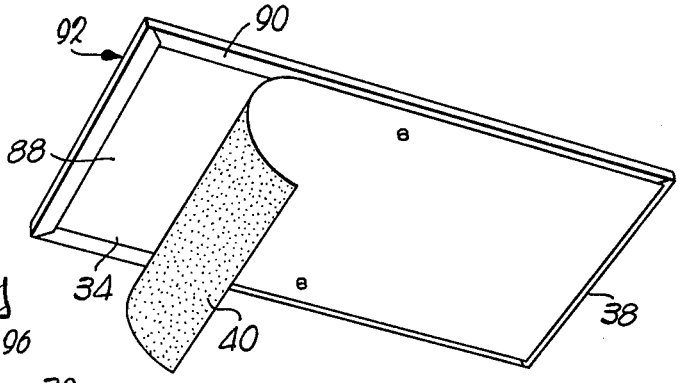
Fig. 11.
Fig. 12.
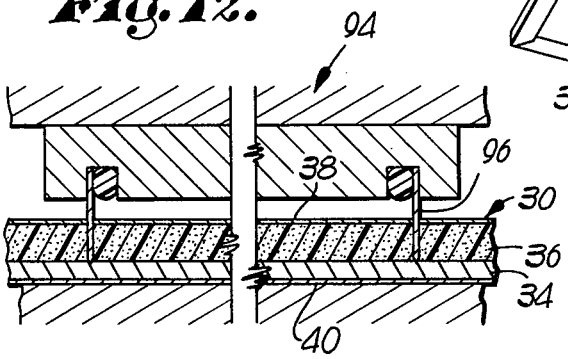

ALBUM HAVING PICTURE RECEIVING FRAME ASSEMBLY IN COVER

This invention relates to book-type album covers in general, and particulary concerns a padded cover having an imbedded frame assembly for displaying a personalizing photograph or the like on the front of the album.

The recent increase in home photography resulting in part from the availability of good quality, low cost photographic equipment in the home market, has resulted in a corresponding increase in demand for quality keepsake photograph albums. Many of these albums are specially designed for a particular event such as the arrival of a new baby and are intended to reserve other memorabilia in addition to photographs. such special purpose albums are now very sophisticated often containing highly creative work and consequently, there exists a desire for a means of personalizing these albums to produce a long-lasting momento truly unique to the individual.

The typical approach to personaization of such albums is to provide a means for displaying a photograph or the like on the front album cover. A number of attempts have been made to present structure suitable for easily mounting a photograph on an album cover for well protected, long-term display but none of the attempts thus far have proved satisfactory in every respect.

As can be appreciated, it is desired to have a device which positively secures the photograph on the album cover in a well protected disposition yet also enables the photograph to be mounted easily therein. In addition, the device sould enhance, rather than detract from, the overall appearance of the album such that the individual is not forced to sacrifice aesthetics for personalization.

One recent attempt to satisfy the needs discussed above, is disclosed in U.S. Letters Pat. No. 4,001,960 issued to Holson on Jan. 11th, 1977. This patent shows a picture holding device which is mounted to a padded album cover by structure projecting through a hole cut in the cover and engaging the back side of the latter to clamp the picture mounting portion of the device against the front surface of the cover. A problem with this device is the structure which engages the inside surface of the cover destroys the normal smooth appearance of this surface and presents a protuberance which can cause undesired embossing or other damage to the first pages in the album. Moreover, the device disclosed is supported only around its periphery by the album cover such that a significant possibility exists that the device will be accidentally dislodged from its mounting engagement with the album cover. This is particularly true if the cover is of a padded type since the engagement between the picture holding device and the album cover may be adversely effected when the cover is compressed in areas adjacent the device as would likely happen during normal handing of the album.

Accordingly, it is an important object of the present invention to provide a padded album cover with a low cost, permanently mounted, highly protective, photograph displaying means for personalization of the album by the user.

In accordance with the foregoing object, it is another important object of our invention to provide a padded album cover having a photograph-receiving tray imbedded in a blind opening through the face of the cover and securely supported by the cover backing member.

As a corollary to the above object it is yet another object of my invention to provide a padded album cover having a photograph display device wherein no portion of the device projects through the cover to the inside surface thereof.

In the drawing:

FIG. 8 is a perspective view showing the original shape of the protective overlay;

FIG. 9 is a perspective view showing the arrangement of the front, spine, and back boards on the protective overlay;

FIG. 10 is a perspective view showing attachment of the overlay to the boards;

FIG. 11 is a perspective view showing mounting of the endliner to the album cover;

FIG. 12 is a fragmentary, cross-sectional view showing the die-cut operation on the front cover of the album;

Figure 1:
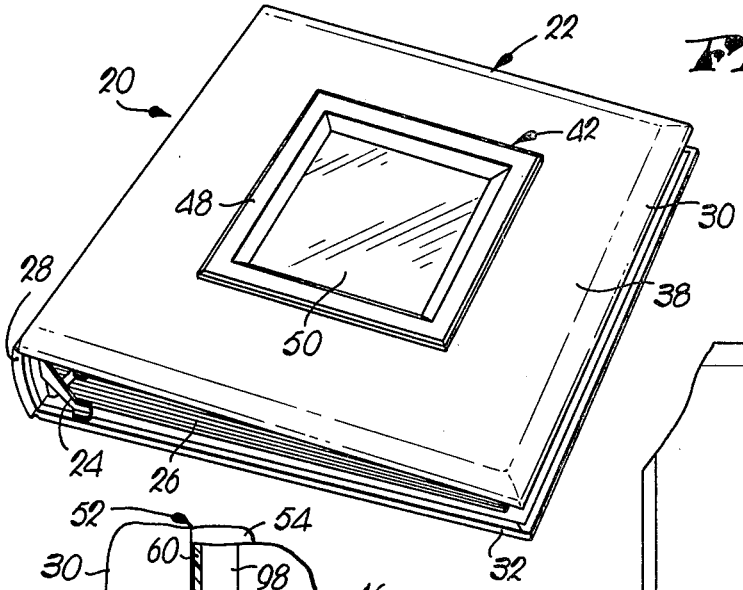
FIG. 1 is a perspective view of an album having picture receiving frame assembly in cover constructed in accordance with the principles of the present invention.

There is shown in FIG. 1 a personalized keepsake album 20 including a padded cover 22, a ring mechanism 24 mounted on the inside of the cover 22 and a plurality of ages 26 secured within the cover 22 by the mechanism 24. The cover 22 includes a spine 28 and front and back leaves 30 and 32 respectively each pivotally secured to the spine 28 such that the cover 22 may be readily opened and closed for selectively providing access to the pages 26.

Figure 6:
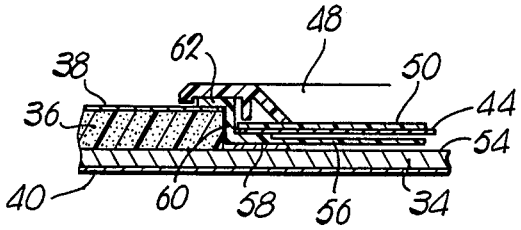
FIG. 6 is a cross-sectional view taken along line 6—6 of FIG. 5.
Figure 7:
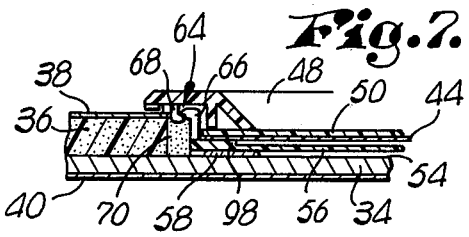
FIG. 7 is a cross-sectional view taken along line 7—7 of FIG. 5.

As shown for example in FIGS. 6 and 7, the cover 30, as well as the back 32 and spine 28, includes a core comprising a rigid backing member 34 and a layer of resilient, synthetic resinous foam 36 on one face of the member 34. A vinyl overlay 38 covers the foam side of the core and an endliner 40 of similar material covers the exposed side of the backing member 34.

The front leaf 30 has a frame assembly 42 imbedded therein in a manner to be described and for the purpose of displaying a photograph 44 on the outside of the cover 22. The assembly 42 includes a shallow, rectangular, photograph-receiving tray 46, a decorative frame 48 adapted to releasably engage the tray 46 around the outer margin of the latter, and a clear triacetate lens 50 held in overlying relationship to the tray 46 by the frame 48. When the assembly 42 is in a display configuration, the photograph 44 is disclosed within the tray 46 and the lens 50 is protectively superimposed there upon.

Figure 13:
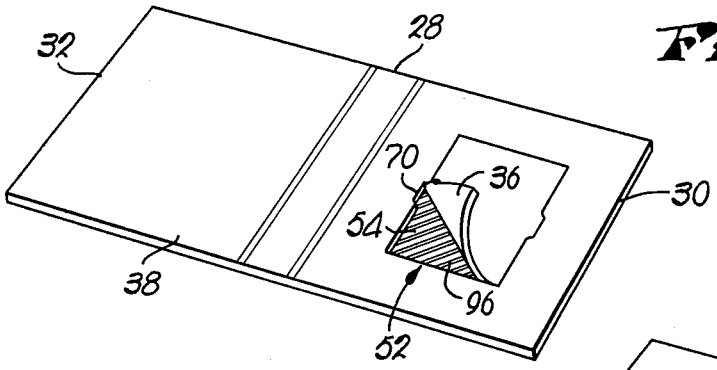
FIG. 13 is a perspective view showing removal of the die-cut portion from the front cover of the album.
Figure 14:
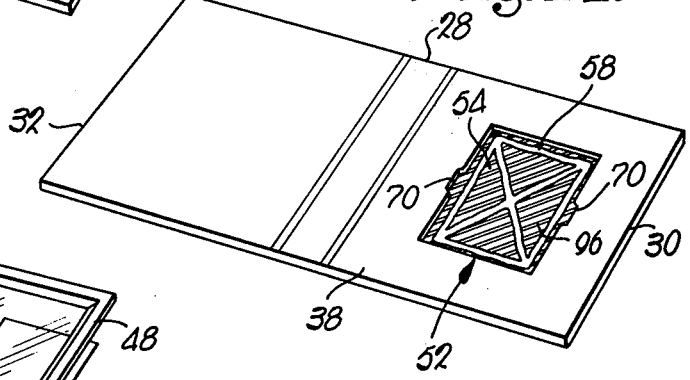
FIG. 14 is a perspective view showing arrangement of the glue pattern on the bottom of the die-cut opening.
Figure 15:
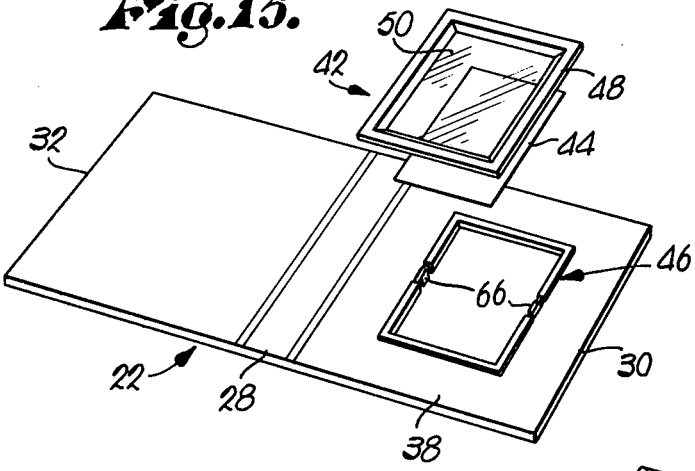
FIG. 15 is a perspective view showing positioning of the frame assembly on the album cover.
Figure 16:
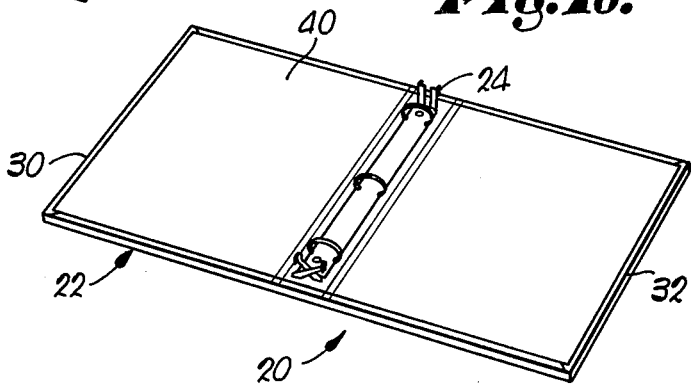
FIG. 16 is a perspective view showing the inside of the finished album cover.

The tray 46 of assembly 42 is retained within a blind, die-cut opening 52 which, as best shown in figures 13 and 14, extends through the overlay 38 and foam 36 and has a bottom wall defined by an exposed rectangular portion 54 of the backing member 34. In preferred forms, the opening 52 is configured to complementally receive the tray 46 such that the sidewalls of the latter are frictionally engaged by the foam layer 36.

The tray 46 has a lowermost flat bottom 56 abutting against and supported by the rectangular portion 54 with a thin layer of hot melt adhesive 58 disposed therebetween for securely holding the tray 46 to the front leaf 30. A circumscribing sidewall 60 of the tray 46 extends for the bottom 56 to a uppermost flange 62 which contacts the portion of overlay 38 bordering the opening 52.

Snap fit means in the form of a pair of opposed snap-type latches 64 is provided for the purpose of releasably retaining the frame 48 to the tray 46. Each latch 64 includes an upstanding yieldable catch 66 centrally disposed along one edge of the tray 46 and a mating depending hook structure 68 similarly disposed on the frame 48. In this manner, the frame 48 can be quickly and securely attached to the tray 46 by a simple downward pressure adjacently hook structure 68 yet quick-release capability is provided if desired by merely deforming slightly the frame 48 to cause the hook structures 68 to release from engagement with corresponding catches 66. A pair of cut-outs 70 are formed in the opening 52 in order to accommodate the latches 64.

Figure 2:
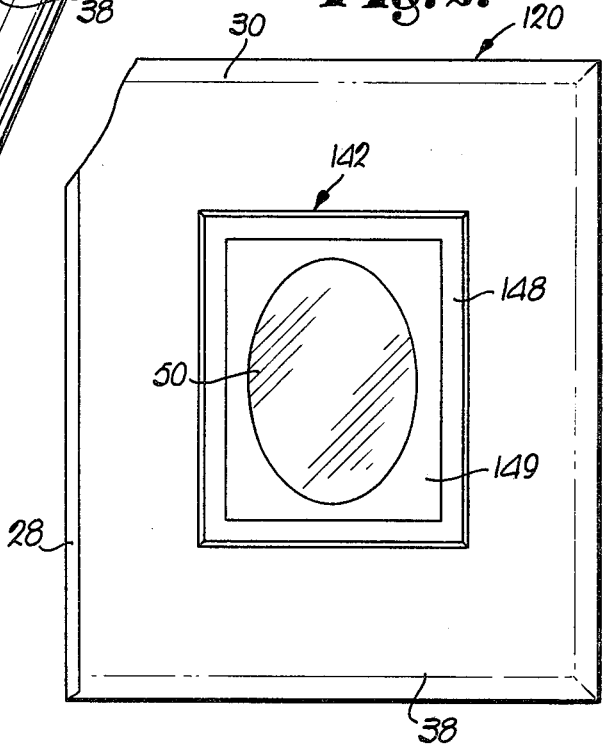
FIG. 2 is an enlarged, fragmentary, front elevational view of the album with a second embodiment of the frame assembly imbedded in the cover.
Figure 5:
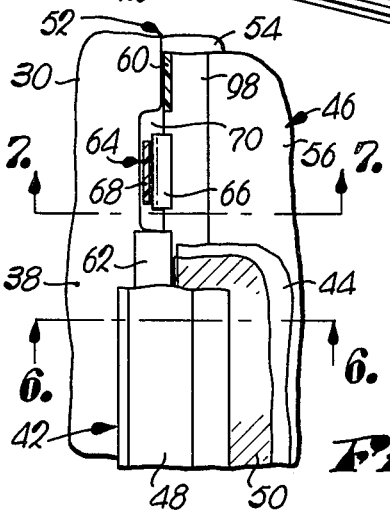
FIG. 5 is an enlarged detail view of the frame assembly illustrating the snap fit securement between the frame and tray.

In FIG. 2 there is shown an alternate embodiment of the invention in the form of an album 120 which is identical to the album 20 with the exception that there is provided a frame assembly 142 instead of the assembly 42. Assembly 142 is likewise similar to the frame assembly 42 in all respects with the exception that a decorative frame 148 has a masking section 149 which defines an oval photograph display area.

Figure 3:
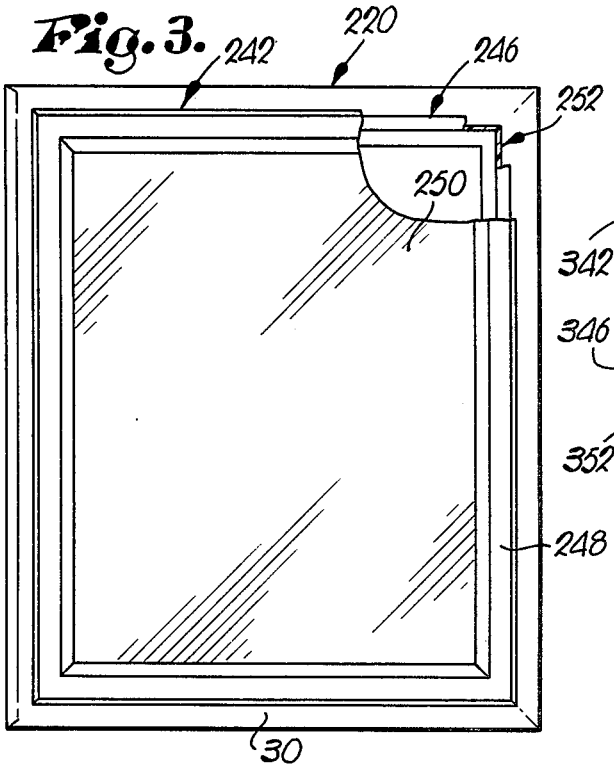
FIG. 3 is a fragmentary, enlarged, front elevational view of the album showing a third embodiment of the frame assembly imbedded in the cover.

A third embodiment as shown in FIG. 3 comprises an album 220 which is also similar to the album 20 with the exception that there is substituted a frame assembly 242 of a substantially larger size than the assembly 42 in order that much larger photographs may be accommodated. Accordingly, assembly 242 comprises a tray 246, a decorative frame 248, and a triacetate lens 250 which are identical in all respects, except size, to the tray 46, frame 48 and lens 50 of the assembly 42 described hereinabove. Of course, there is also provided an enlarged die-cut opening 252 to receive the larger tray 246.

Figure 4:
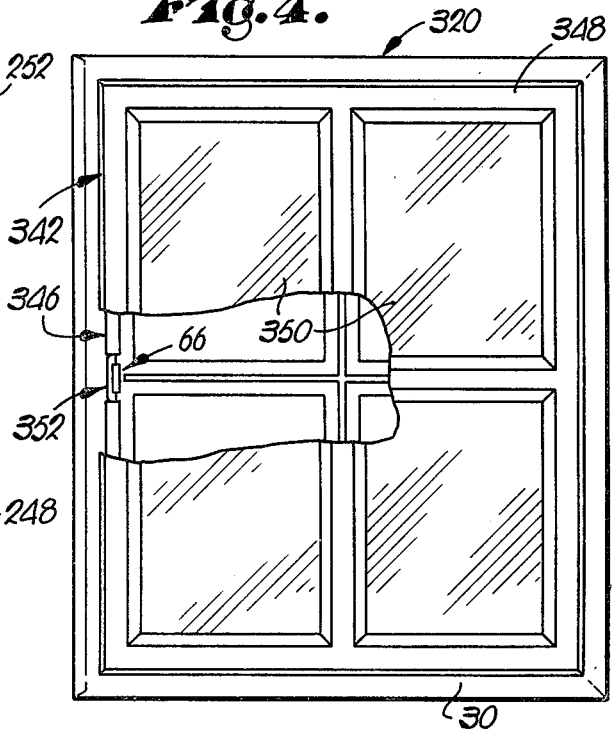
FIG. 4 is a fragmentary, enlarged, front elevational view showing a fourth embodiment of the frame assembly imbedded in the cover.

Similarly, the embodiment of th album shown in FIG. 4 and designated 320 is constructed identically to the album 20 with the exception that a frame assembly 342 is substituted for the assembly 42. The assembly 342 includes a frame 348 having four separate viewing panes such that four individual photographs 44 may be displayed on the front leaf 30. Additionally, assembly 342 has an enlarged four-section tray 346 and a lens 350 for each section of tray 346, as well as a larger die-cut opening 352 corresponding to the opening 242.

FIGS. 8-16 illustrate the various process steps for the construction of the album 20. A presized vinyl overlay 38 is adhesively bonded to core material pieces 84, 86, and 88 corresponding respectively to the front leaf 30, spine 28, and back leaf 32 of the finished cover 22. As previously explained, the overlay 38 is bonded to the foam side of the pieces 84, 86, 88. An overlapping edge 90 of the overlay 38 is folded around the outer peripheral edge presented by the pieces 84, 86, and 88 to form a cover subassembly 92 in the manner illustrated in FIG. 11.

As shown in FIG. 13, the die-cut portion is removed to form the blind opening 52 and expose the portion 54 of the backing member 34. Note 33 also in FIG. 13 that glue 96 between the foam layer 36 and the backing member 34 is applied intermittently rather than in a continuous film such that is relatively easy to separate the die-cut portion of the foam layer 38 from the backing member 34.

The next step in the process is to apply hot melt adhesive 58 to the portion 54 in a pattern similar to that shown FIG. 14 and then insert the tray 46 into the opening 52 such that the bottom 56 is securely bonded to the portion 54 of the backing member 34. Next a photograph 44 or graphic representation thereof is inserted into the tray 46 and the lens 50 is secured thereover by attachment of the frame 48 to the tray 46.

Finally, the ring mechanism 24 is mounted on the inside of the spine 28 and the appropriate pages 26 are placed in the mechanism 24.

The use of the present invention should be apparent from the foregoing description. The album owner simply selects a photograph 44 which he feels will personalize hs album and then inserts this photograph 44 into the frame assembly 42. Note that as shown in FIGS. 6 and 7, the photograph 44 will normally be carried in a plane offset below the overlay 38 such that there is presented a recessed display of the photograph 44.

Tray 46 is dimensioned to automatically center a 4×5 professional proof or trimmed 126 film print, and there is provided a step 98 for centrally positioning smaller $3\frac{1}{2}\times4\frac{1}{2}$prints from 110 film.

From the above, it is clear that the present invention provides an effective solution to the problem of displaying a photograph on the cover of an album in a permanent, well-protected manner. The frame assembly 42 permits the user to quickly and easily personalize the album 20 by inserting a selected photograph 44 into the tray 46 and securing the photograph behind lens 50 through the expedient of coupling the frame 48 with the tray 46.

The engagement of bottom 56 with the rectangular portion 54 of backing member 34 assures that the frame assembly 42 is adequately supported and rigidly attached to the front leaf 30. This "blind mount" construction is far superior to known prior art devices not only from the standpoint of support and mounting advantages but also from the standpoint of appearance inasmuch as there is no unsightly structure on the inside portion of the front leaf 30. The smooth contour maintained on the inner-portion of the front leaf 30 also assures that the front pages of the album are not embossed, torn, or otherwise damaged during normal handling and storage.

It will also be appreciated that the unique construction of cover assembly 22 renders it comparatively inexpensive to manufacture thereby enhancing the marketability of the product. Specifically, the complemental configuration of tray 46 and opening 52, the simple snap fit arrangement of the assembly 42, and the one-piece molded construction of tray 46 and frame 48, all contribute to simplify the assembly operation for the cover 22 such that there is eliminated the need for time-consuming precision layout in the manufacturing process.

We claim:

1. In a photo-album, the combination of a padded, bound cover and picture display frame assembly comprising:

a substantially rigid, planar backing member generally conforming in configuration to that section of the cover receiving the picture display frame.

a layer of resilient foam padding of predetermined thickness on one face of the backing member;

a protective overlay panel secured to said member and extending over said padding in covering relationship thereto;

a photograph receiving tray provided with a planar bottom, a sidewall projecting from said bottom of a height substantially equal to that of the layer and said overlay in combination, and a flange joined to the outer marginal portion of the sidewall and projecting outwardly therefrom, said overlay and the padding being provided with aligned, blind die cut opening therein of a shape conforming to that of the tray for complementally receiving the same therein and exposing a portion of the backing member, said tray being telescoped into said openings in the overlay and padding with the bottom engaging and supported by said one face of the backing member and said flange laying against the overlay around the opening therethrough, there being means for securing the bottom of the tray to said backing member and a decorative frame unit having a picture displaying opening therethrough and of a configuration to overlie the side wall of the tray in covering relationship to said flange and engage said overlay, said side wall of the tray and the frame unit being provided with releasably engageable latch elements for removably attaching the frame unit to the tray to permit ready insertion of a photograph in the tray for display thereof behind the frame unit while at the same time allowing easy removal of the photograph as desired by the album user.

2. The bound cover of claim 1, the bottom of said tray being offset below said overlay for displaying said photograph in recessed fashion.

3. An album as set forth in claim 1 wherein said releasable latch elements comprise snap-fit catch and hook structures on the frame unit and said tray respectively located on opposite sides of the assembly in disposition permitting release thereof by slight deformation of the frame.

4. An album as set forth in claim 3 wherein is provided a glass panel configured to fit in said tray and means on said frame unit extending into the tray in disposition to engage said glass panel and bias the latter toward said bottom to firmly hold a photograph in a selected position between the glass panel and said bottom.

5. The method of preparing a bound cover for an album comprising the steps of:

cutting a protective overlay to a predetermined size and shape;

shaping pieces of core material corresponding to the front, spine, and back of said cover, said core material including a rigid backing sheet and a layer of resilient foam supported on one face of the backing sheet;

securing said overlay to the foam side of said pieces in covering relation to the foam layers to form a cover subassembly including a front, spine and back, attaching a endliner to the opposite side of said pieces in covering relation to said backing sheets;

die-cutting an opening in the front of said subassembly which extends through said overlay and said foam and into but not through said backing sheet to expose a portion of the proximal face of said backing sheet;

securing a photograph-receiving tray in said opening with a part of said tray abutting said exposed portion of backing sheet;

attaching a decorative frame to said tray.

* * * * *